US010695259B2

(12) United States Patent
Bouch et al.

(10) Patent No.: US 10,695,259 B2
(45) Date of Patent: Jun. 30, 2020

(54) ADJUSTABLE MASSAGER

(71) Applicants: Dustin J Bouch, Petaluma, CA (US); Eric V Bostrom, Newbury Park, CA (US)

(72) Inventors: Dustin J Bouch, Petaluma, CA (US); Eric V Bostrom, Newbury Park, CA (US)

( * ) Notice: Subject to any disclaimer, the term of this patent is extended or adjusted under 35 U.S.C. 154(b) by 253 days.

(21) Appl. No.: 15/953,301

(22) Filed: Apr. 13, 2018

(65) Prior Publication Data

US 2018/0296430 A1 Oct. 18, 2018

Related U.S. Application Data

(60) Provisional application No. 62/485,020, filed on Apr. 13, 2017.

(51) Int. Cl.
*A61H 15/00* (2006.01)

(52) U.S. Cl.
CPC ..... *A61H 15/00* (2013.01); *A61H 2015/005* (2013.01); *A61H 2015/0007* (2013.01); *A61H 2015/0042* (2013.01); *A61H 2015/0057* (2013.01); *A61H 2201/0119* (2013.01); *A61H 2201/0123* (2013.01); *A61H 2201/0126* (2013.01); *A61H 2201/0157* (2013.01); *A61H 2201/0161* (2013.01); *A61H 2201/0192* (2013.01); *A61H 2201/1253* (2013.01); *A61H 2201/1623* (2013.01); *A61H 2203/0406* (2013.01); *A61H 2205/08* (2013.01); *A61H 2205/081* (2013.01)

(58) Field of Classification Search
CPC ..... A61H 15/00; A61H 15/0092; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 2201/01; A61H 2201/0119; A61H 2201/0123; A61H 2201/0126; A61H 2201/0157; A61H 2201/0161; A61H 2201/1623; A61H 2203/04; A61H 2203/0406; A61H 2203/0425; A61H 2205/08; A61H 2205/081
See application file for complete search history.

(56) References Cited

U.S. PATENT DOCUMENTS 5,897,085 A * 4/1999 Cronin ..... A61G 7/053 248/200.1
6,837,642 B1 * 1/2005 Lin ..... F16B 7/105 403/109.1

(Continued)

*Primary Examiner* — Colin W Stuart
(74) *Attorney, Agent, or Firm* — Dobbin IP Law P.C.; Geoffrey E. Dobbin

(57) ABSTRACT

An improved self-massage apparatus may feature a main mounting bar serving as a body and one or two coaxial and slidable tubes to provide mounting tension. An outer surface may present a rotatable massage head. The two ends of the apparatus may have brackets or other interfaces to secure the apparatus between two parallel surfaces. Clamps, ratchets, and other tension devices may be used to hold the main components in fixed relation to each other and the massage head may rotate a full 360° on at least two planes for a customizable and extremely versatile massage experience.

13 Claims, 19 Drawing Sheets

(56) References Cited

U.S. PATENT DOCUMENTS

| | | | | |
|---|---|---|---|---|
| 8,118,525 | B2 * | 2/2012 | Long | B60P 7/15 410/151 |
| 9,320,675 | B2 * | 4/2016 | Johnson | A61H 15/0092 |
| 2005/0278902 | A1 * | 12/2005 | Wilcox | B60P 7/0861 24/68 CD |
| 2013/0289454 | A1 * | 10/2013 | Wang | A61H 11/00 601/132 |
| 2014/0323275 | A1 * | 10/2014 | Moses, II | A63B 21/1627 482/40 |
| 2015/0245977 | A1 * | 9/2015 | Sungarian | A61H 15/00 601/118 |

* cited by examiner 110
126
138
132
135
134
122
120
124
149
148
146
147
142
141
144

159
158
156
152
154
160
162
116
118
133
136
137
139

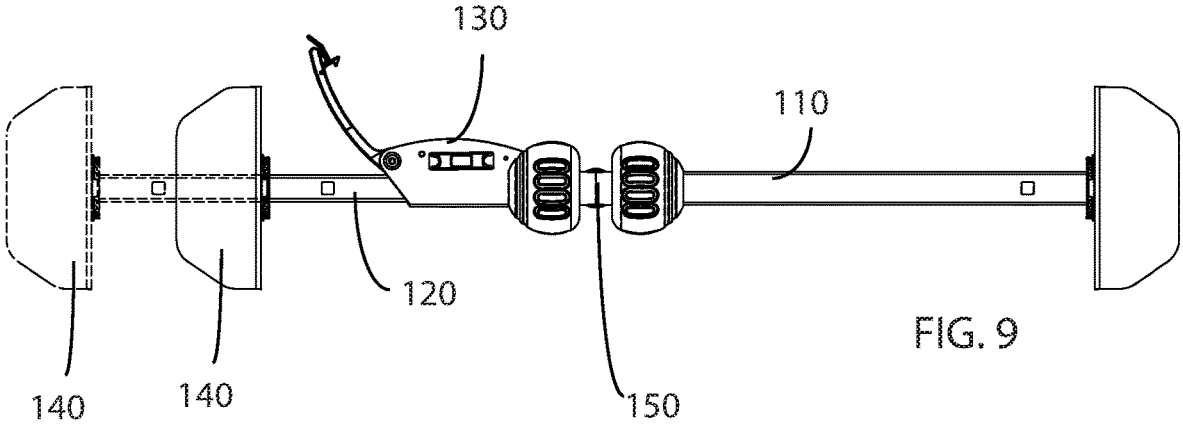
FIG. 9
FIG. 10
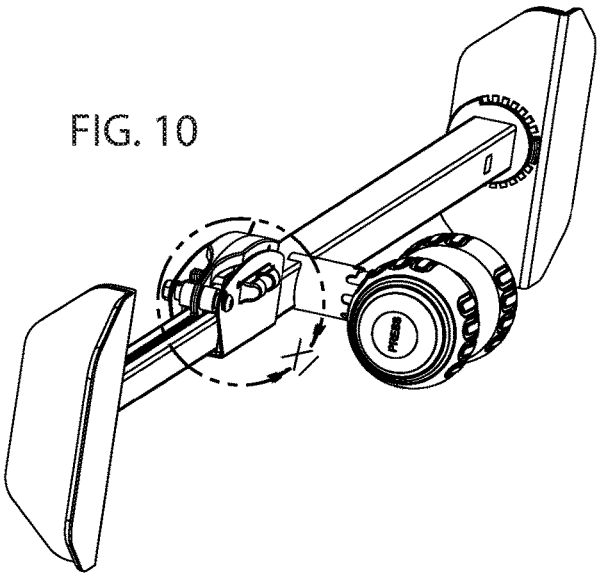

ADJUSTABLE MASSAGER

CROSS-REFERENCES TO RELATED APPLICATIONS

This Application claims priority to prior filed U.S. Application No. 62/485,020, filed Apr. 13, 2017, and incorporates the same by reference in its entirety.

FIELD OF THE INVENTION

The present invention relates to the field of massagers and more particularly relates to a massager which mounts to a door frame or similar structure and is adjustable for use.

BACKGROUND OF THE INVENTION

Massage is an ancient art. Since ancient time, people have found that the rubbing and stimulation of muscles in the limbs, back, torso, and anywhere in the body had a therapeutic effect in a variety of ways, such as: working out lactic acid and other toxins built up in the muscles; injury and ailment rehabilitation; pain relief; headache and muscle tension relief; the breaking up of scar tissue; increasing mobility and flexibility; and, the stimulation of circulatory system for a variety of health purposes. As such, the massage industry is seen as providing a valuable service to society and various tools have been developed for massage, be it to be used on another individual or to be used on one's self. Massage tools made for one's self are of particular importance as a masseuse may not be available to an individual due to availability or affordability and certain parts of the body are notoriously hard to reach by one's self.

The present invention is a massage tool that mounts to structure in a manner to present a self-massage surface keyed to work an individual's back, neck, shoulders, arms, legs and torso and entire body. The surface is fully adjustable in along at least two axes so as to present a versatile surface for self-massage of the entire body, including the back, neck, arms, legs in various positions from standing, to being seated to lying on the ground. The tool is also externally mounted, instead of self-actuated. As such, the user does not have to exert additional effort in executing self-massage. This feature being of importance with individuals with lower motion capabilities or dexterity.

SUMMARY OF THE INVENTION

A self-massage apparatus may provide a mounting mechanism that is easily affixed between two adjacent posts, such as in a doorway, and may then rigidly provide a massage surface which is adjustable in its orientation relative to the apparatus. Such a massager would meet the following objectives: ease of set-up and use, adaptability to different individuals, effective use, and secure anchoring of the apparatus to its support structure. As such, a new and improved self-massage apparatus may comprise a plurality of tension bars with which to interface adjacent posts, such as in a doorway, and also a massage head which is rotatable and also may be angularly displaced on the massager so as to adapt to individual users and particular target areas. The massage head itself may have replaceable components for different massage effects. With proper applied tension, the apparatus will brace against the adjacent posts and resist both the downward pull of gravity and the lateral pressure applied by a user.

The more important features of a self-massage apparatus have thus been outlined in order that the more detailed description that follows may be better understood and in order that the present contribution to the art may better be appreciated. Additional features of the apparatus will be described hereinafter and will form the subject matter of the claims that follow.

Many other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 9 is a front elevation of the self-massage apparatus of FIG. 1, illustrating the extension capability of the apparatus.

FIG. 10 is an alternate perspective view of the self-massage apparatus of FIG. 1.

DETAILED DESCRIPTION OF THE PREFERRED EMBODIMENT

Figure 1:
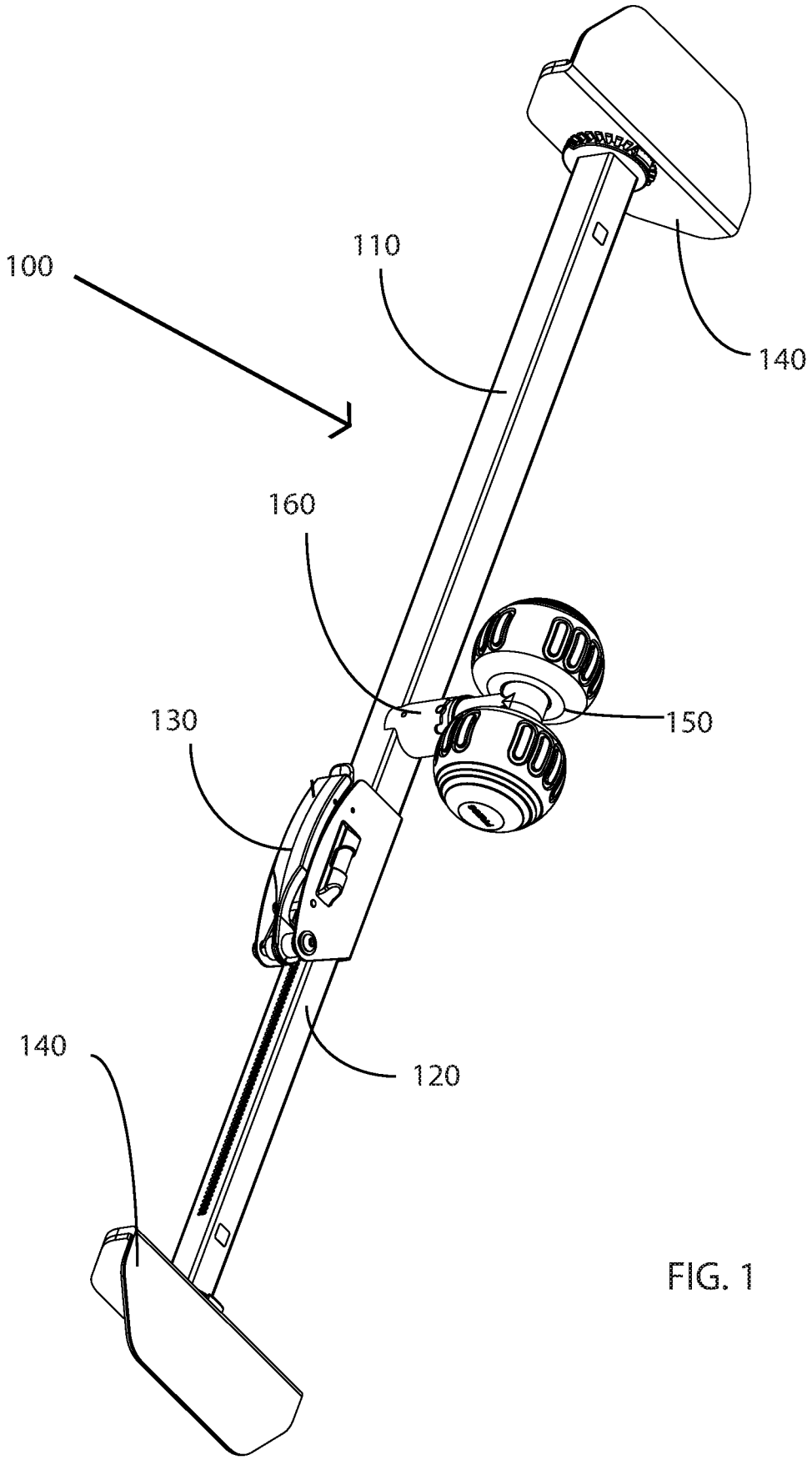
FIG. 1 is a perspective view of a self-massage apparatus.
Figure 2:
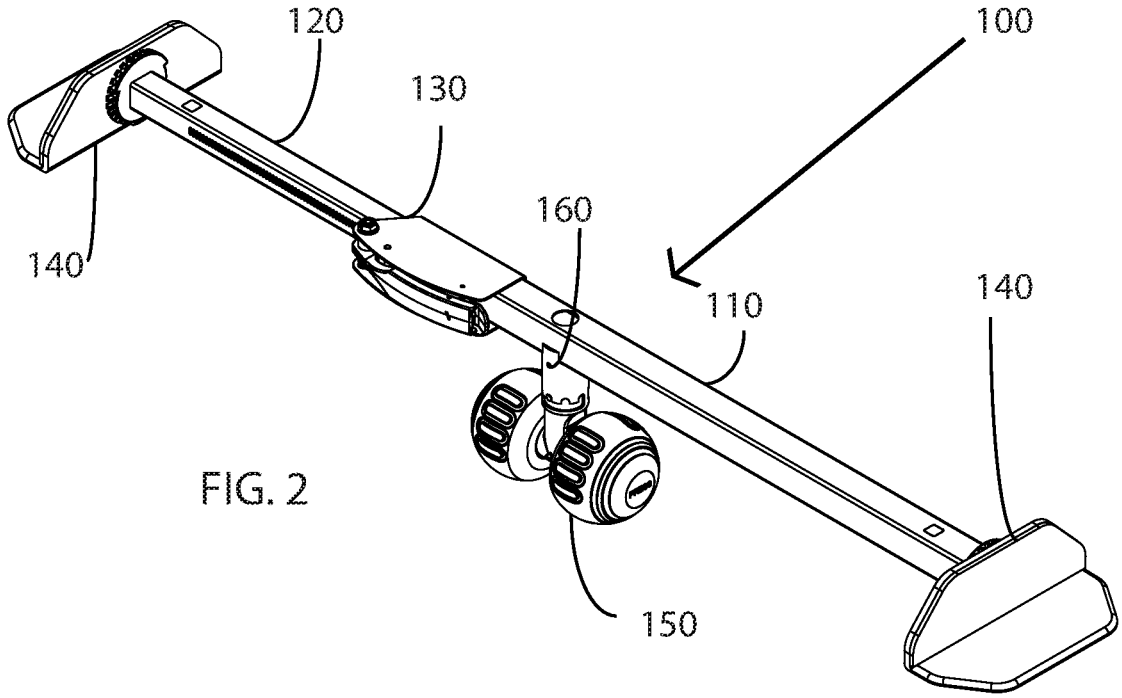
FIG. 2 is an alternate perspective view of the self-massage apparatus of FIG. 1.
Figure 3:
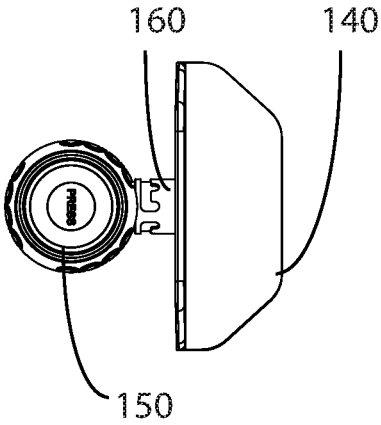
FIG. 3 is a side elevation of the self-massage apparatus of FIG. 1.
Figure 4:
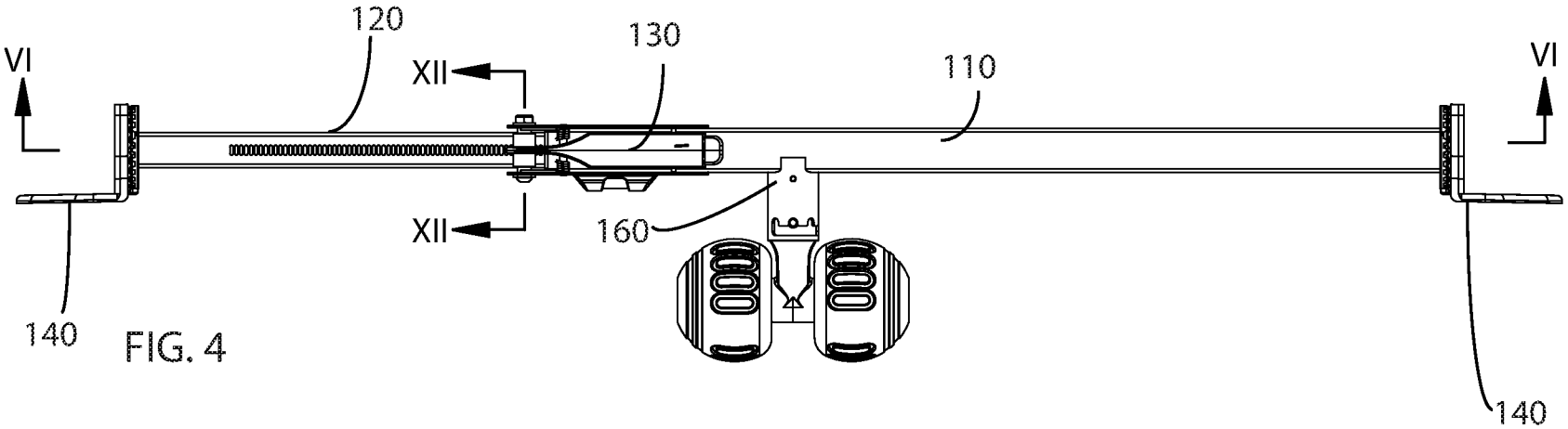
FIG. 4 is top plan view of the self-massage apparatus of FIG. 1.
Figure 5:
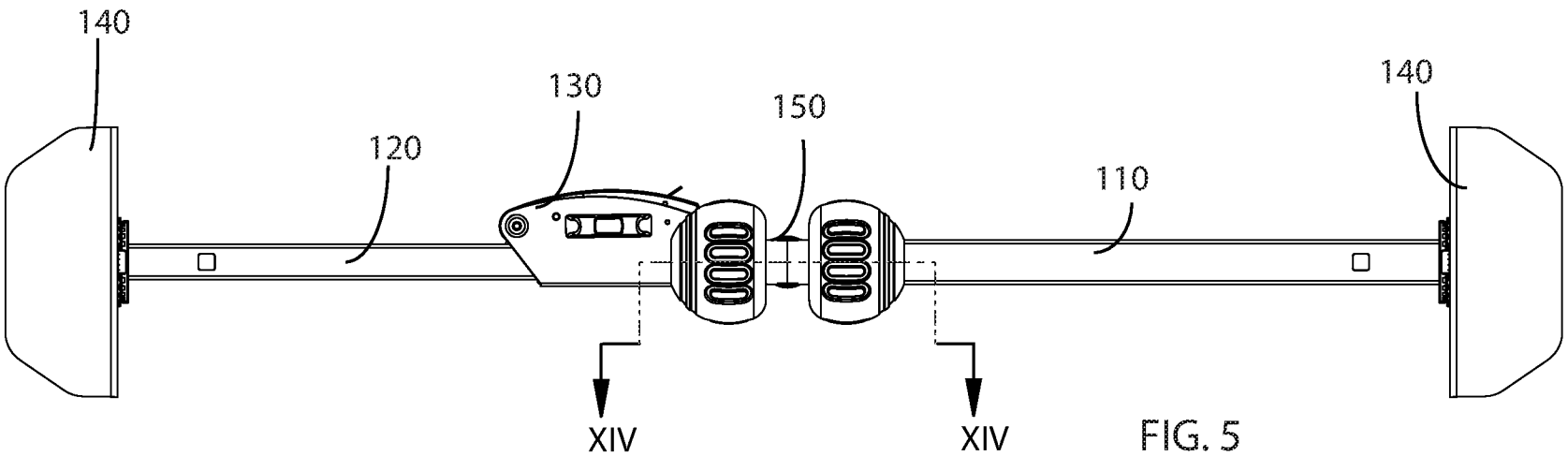
FIG. 5 front elevation of the self-massage apparatus of FIG. 1.

With reference now to the drawings, a preferred embodiment of a self-massage apparatus is herein described. It should be noted that the articles "a", "an", and "the", as used in this specification, include plural referents unless the content clearly dictates otherwise.

With reference to FIGS. 1-6, a self-massage apparatus 100 may have a hollow outer support tube (or "sleeve") 110 and a coaxial inner rod or tube 120 slidable within. It should be noted that the structures herein described as "tubes" are square. The terms "tube" and "rod" should not be taken to imply a set circular shape and should be read to include any suitable polygonal cross-section. Inner tube 120 should present a series of ridges 122 along an upper side. A latch mechanism 130 may reside on an end of outer support tube 110 through which the inner tube 120 may slide while presenting the series of ridges 122 for interface with the latch 130. This would then leave one end of the outer support tube 110 and one end of the inner tube serving as opposed ends of the self-massage apparatus 100. Each of these ends may be provided end brackets 140 having two walls at a generally right angle to each other, providing two perpendicular interface surfaces. Massage head 150 may be positioned on a pedestal 160 fixed to the outer support tube 120.

Figures 6, 7:
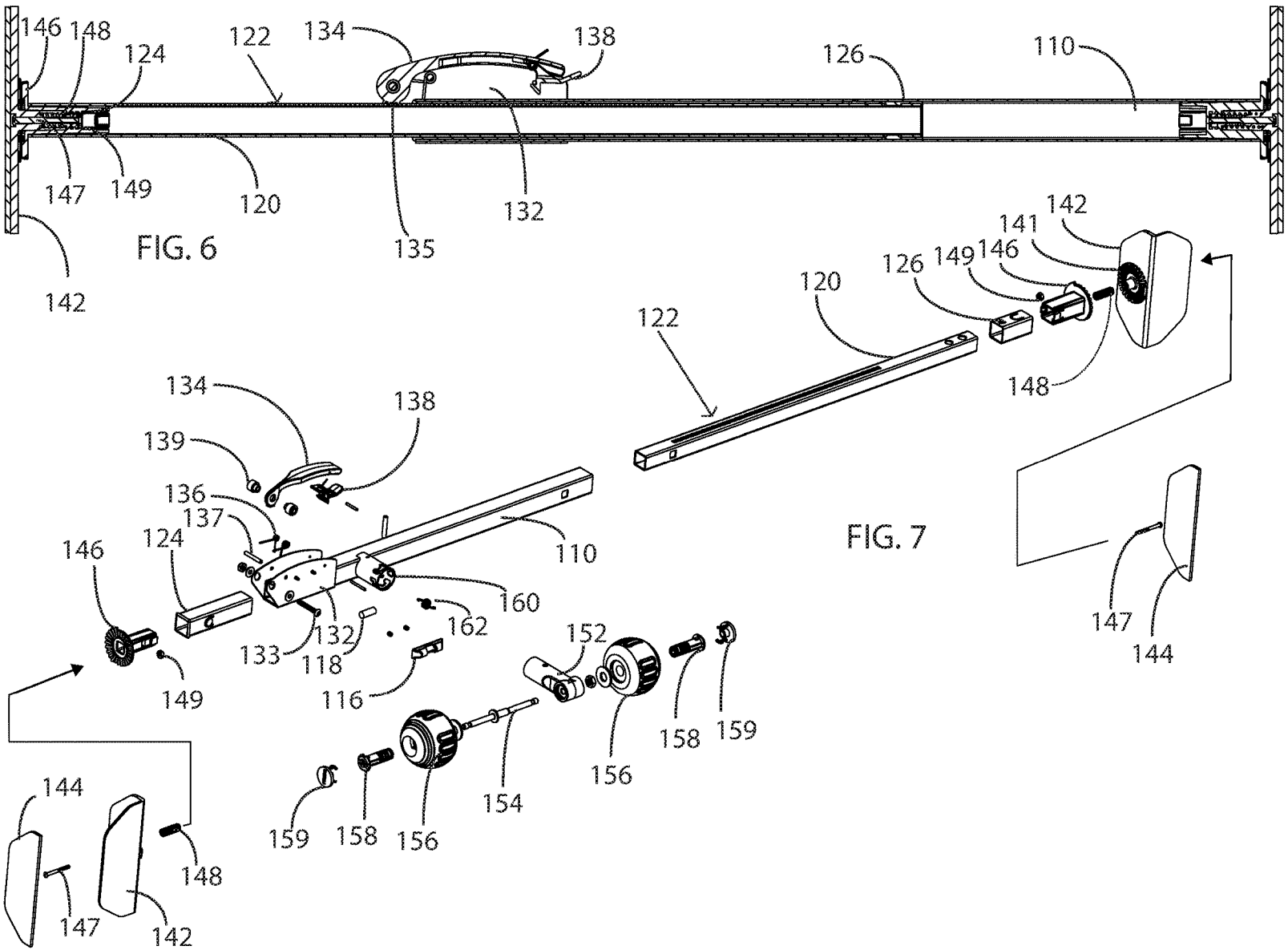
FIG. 6 is a sectional of the self-massage apparatus of FIG. 4, taken along line VI-VI.
FIG. 7 is an exploded view of the self-massage apparatus of FIG. 1.
Figure 8:
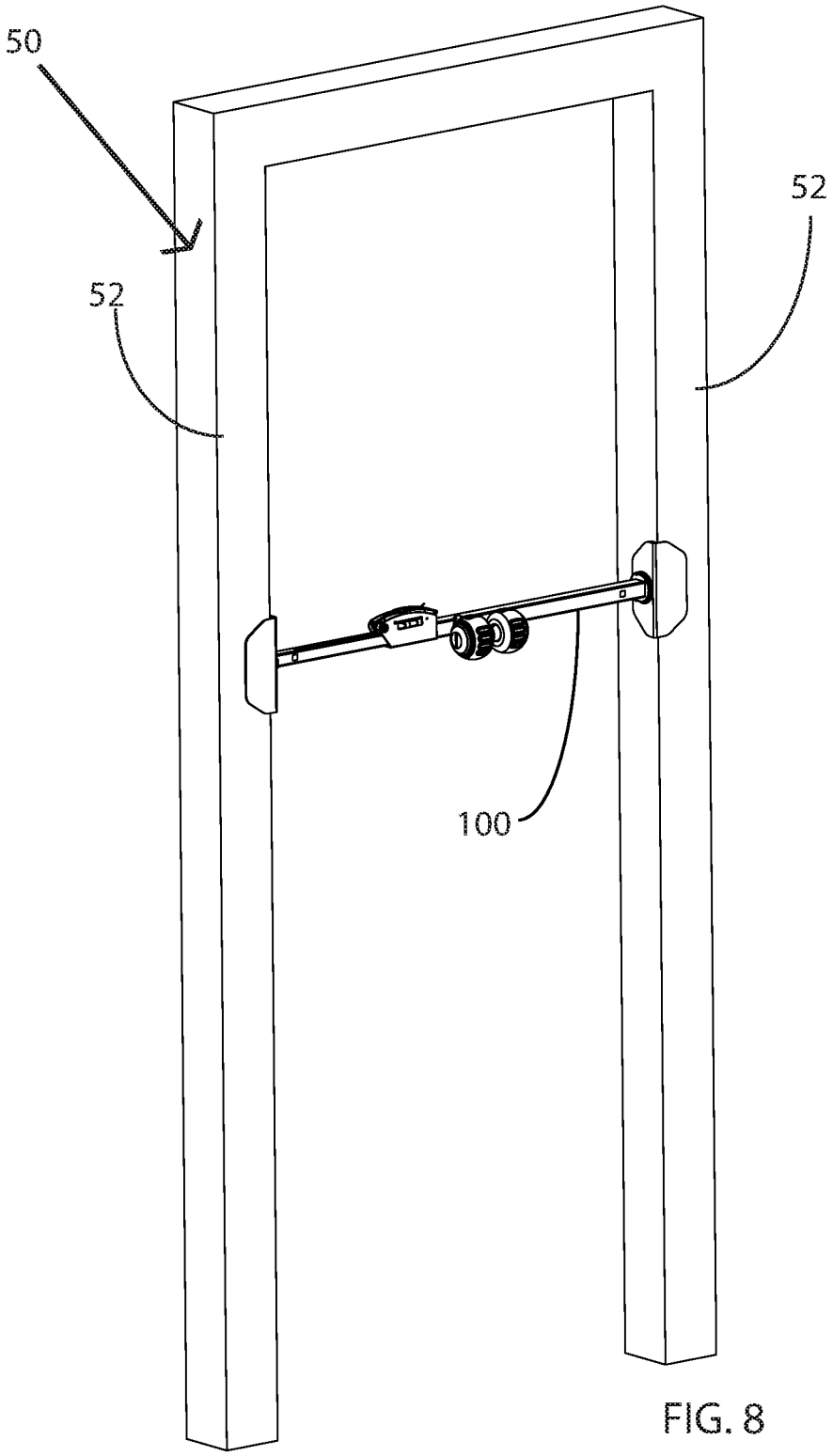
FIG. 8 is a perspective view of the self-massage apparatus of FIG. 1, mounted in a doorway.
Figure 11:
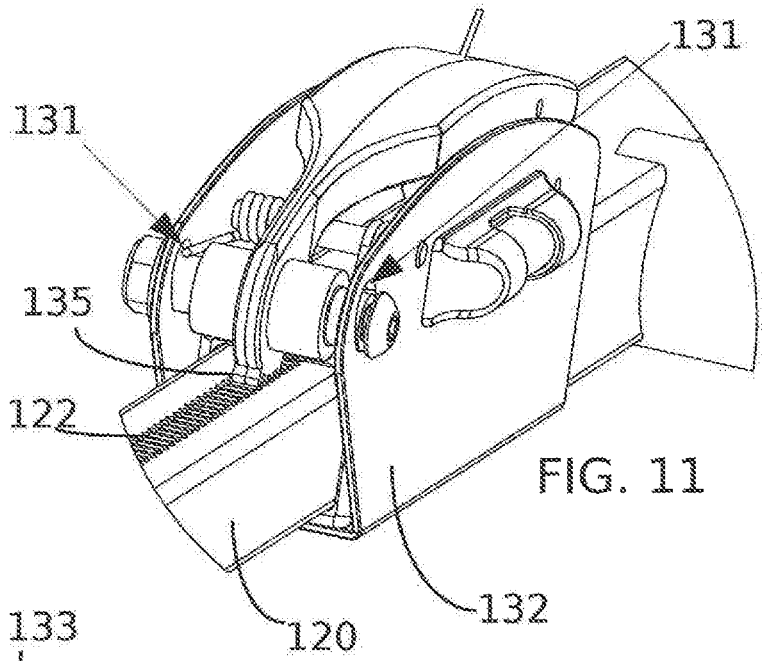
FIG. 11 is a close-up view of the latching mechanism shown in FIG. 12, taken in circle XI.
Figure 12:
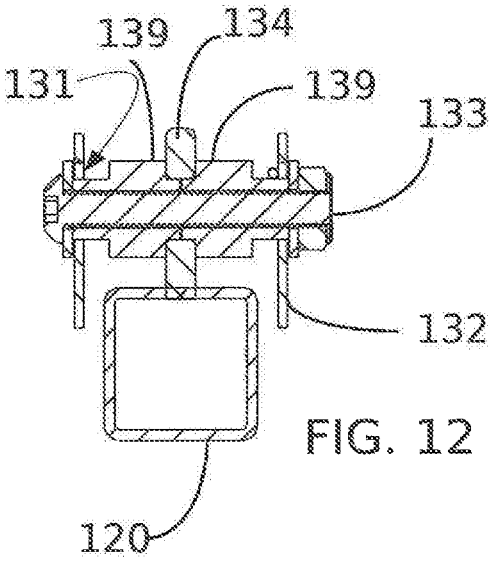
FIG. 12 is a sectional of the latch mechanism for the self-massage apparatus of FIG. 4, taken along line XII.
Figure 13:
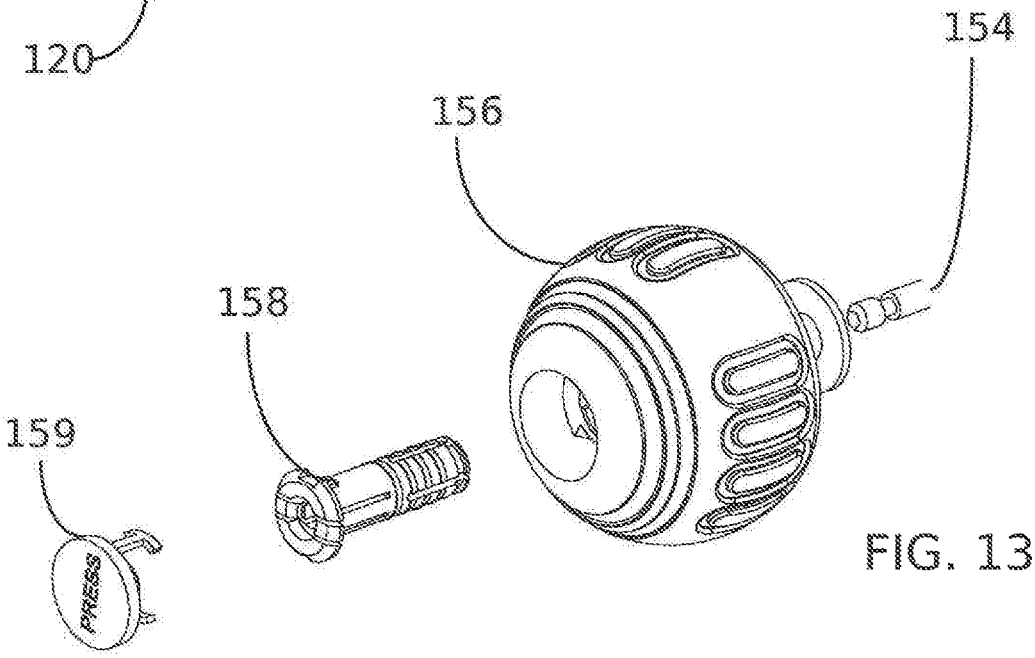
FIG. 13 is an exploded view of a massage ball used in the massage head of for the self-massage apparatus of FIG. 1.

The self-massage apparatus 100 will be able to mount in any suitably sized opening between two opposed corner surfaces, such as with opposed jambs 52 in a door frame 50. Extension of the inner tube 120 with respect to the outer support tube 110 provides the support necessary to secure the self-massage apparatus in a door frame 50 (FIG. 8). The extension is accomplished by two actions. The first action is the gross sliding movement between the two tubes 110, 120. When the latch 130 is unsecured, the two tubes 110, 120 are free to move with respect to each other (FIG. 9). The use of an end cap 126 and a guide 124 interacting with the two ends of the inner tube 120 aid in stability as it slides within outer support tube 110 (FIGS. 6 and 7). They are easily positioned to abut their end brackets 140 against the jambs of the frame 50 and held in position. Then the second motion is a leveraged extension caused by the closing of the latch 130 (FIGS. 7, 10-12). This extends the inner tube 120 a small amount further out than human hand interaction alone can apply and this provides the locking force needed to secure the self-massage apparatus in place. The ideal latch mechanism 130 resides on the outer support tube 120 and is supported by two side walls 132. A latch lever 134 is pivotably mounted between the walls 132 on a bolt 133 and spring biased 136 to interface with the inner tube 120. Springs 136 may be torsion springs mounted upon a spring mount 137 likewise between the side walls 132. As the latch lever is biased open, a locking mechanism 138 is provided to keep the latch lever 134 closed. Bushings 139 may be provided to aid in reducing friction. When closed, teeth 135 on the latch lever 134 will interface with and grab individual grooves 122 on the inner tube 120, and as it rotates it will push the inner tube 120 outward, providing the additional tension needed to lock the self-massage apparatus 100 in place. In FIG. 12, it should be noted that the mounting bolt 133 is secured in a slanted pill-shaped hole 131 in the latch side walls 132. This allows some degree of play and prevents binding of the teeth 135 with the series of grooves 122, allowing them to properly mesh and self-align. The spring bias provided by torsion springs 136 bias the latch lever 134 downwards into the series of grooves 122 so that when such play is no longer needed, the latch lever 134 and inner tube 120 are again correctly aligned. The slant in the pill-shaped hole 131 travels downwards as the hole propagates from the latch interface at the end of the outer support tube 110. This forces the mounting bolt 133 downward when there is tension between the inner 120 and outer 110 tubes.

Figure 14:
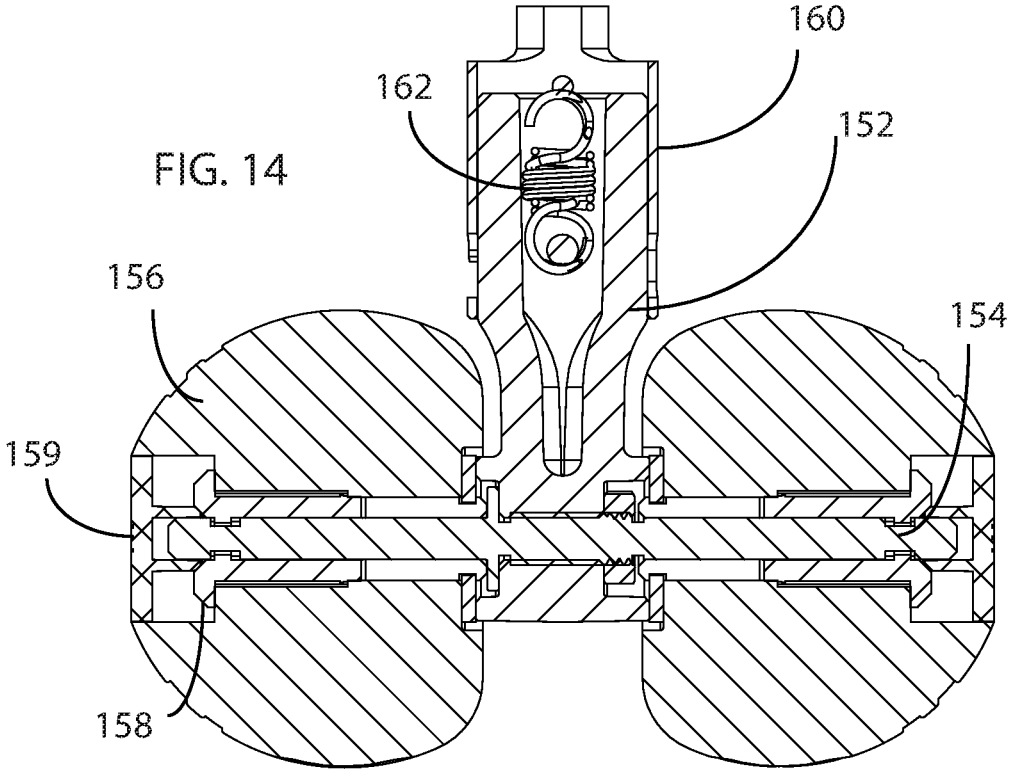
FIG. 14 is a sectional of the massage head for the self-massage apparatus of FIG. 5, taken along line XIV-XIV.
Figure 15:
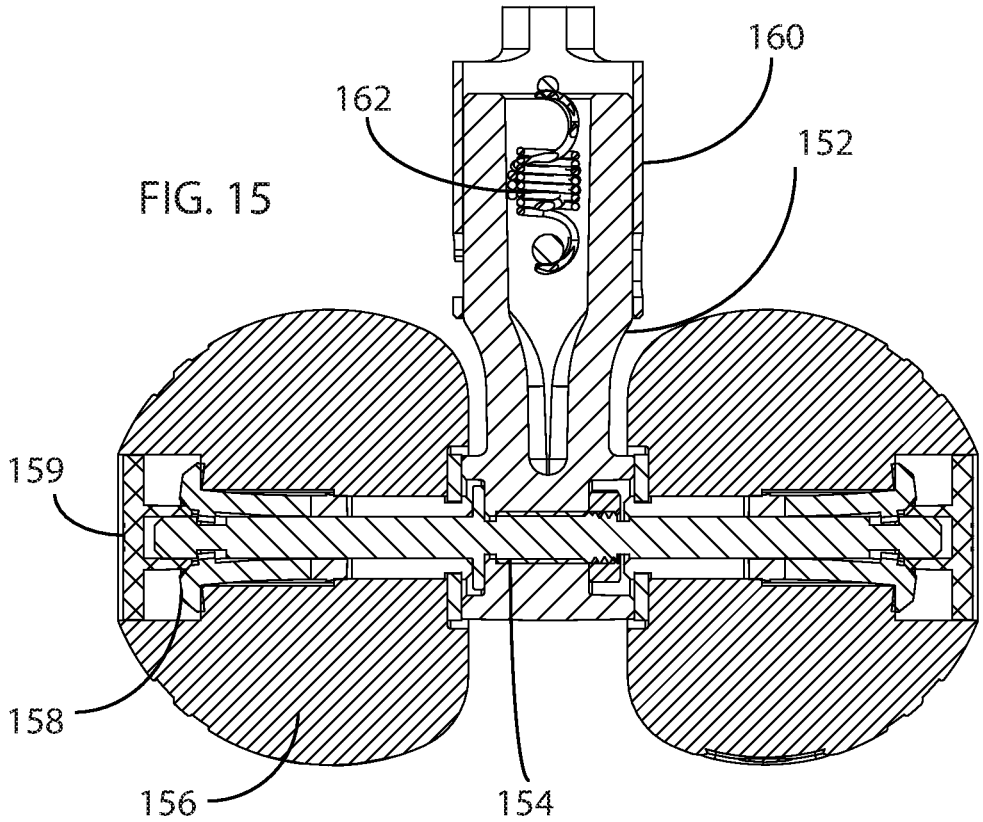
FIG. 15 is an alternate sectional view of the massage head of FIG. 9, with the massage balls unsecured.
Figures 16A, 16B, 16C, 16D:
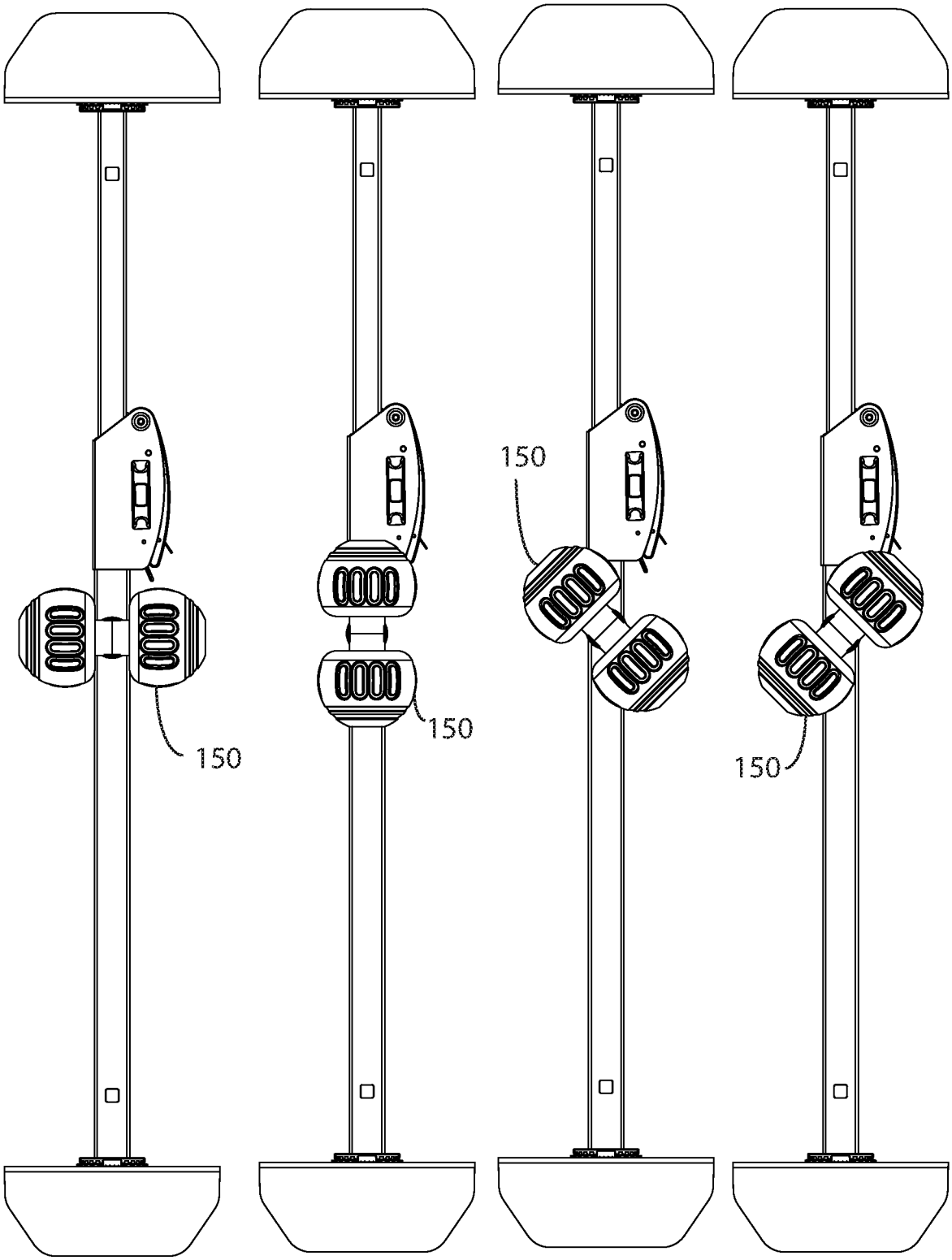
FIGS. 16A-16D are top plan views of the self-massage apparatus of FIG. 1, showing different stages of rotation of the massage head.
Figure 17:
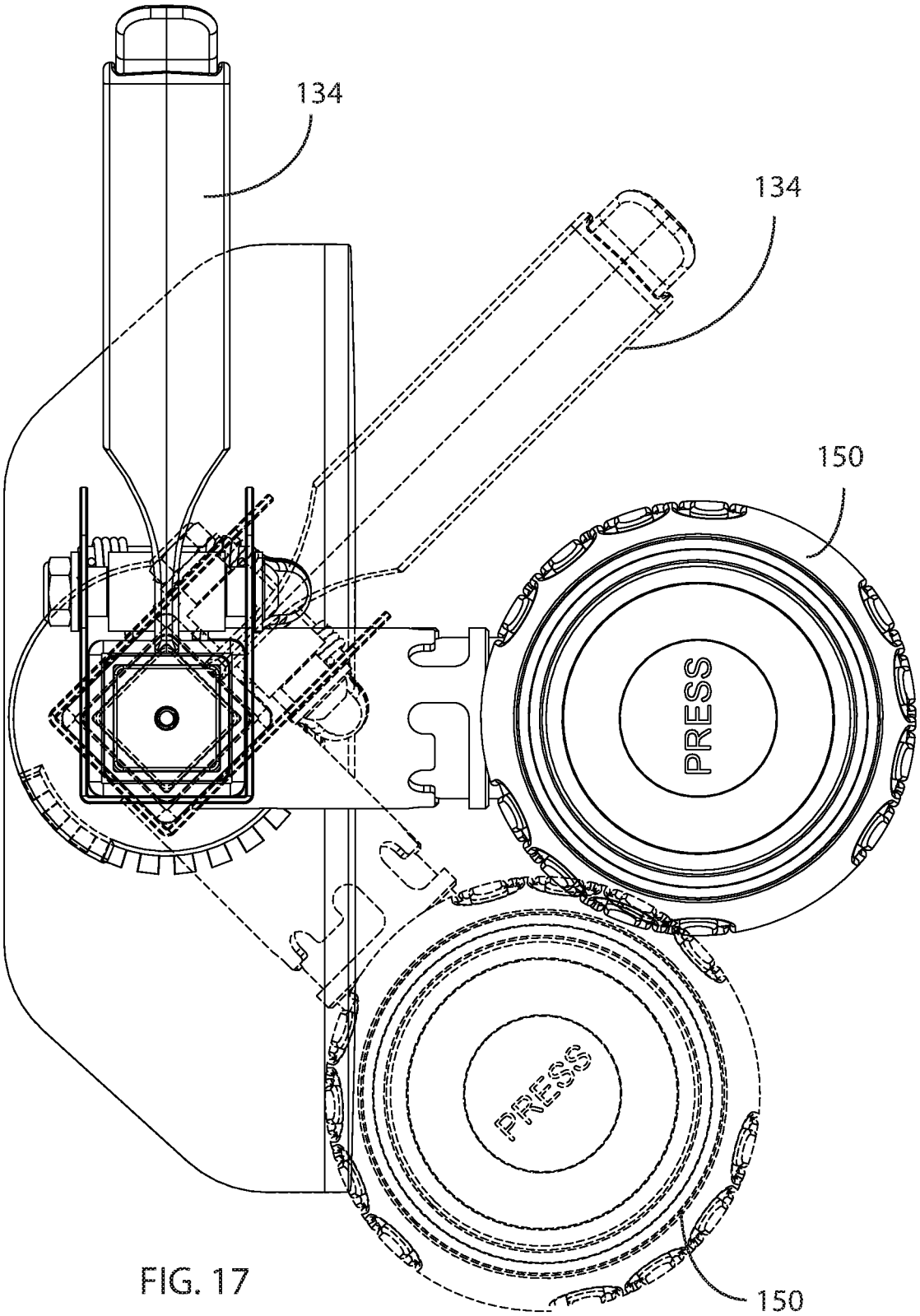
FIG. 17 is a side elevation of the massage head, showing rotational displacement.

The massage head 150 (FIGS. 7, 13-15) may have a massage surface which may take any shape useful in the working of human tissues; but the preferred embodiment is a caster formed of two co-acting massage balls 156 mounted on the same axle 154 and supported by a caster body 152. Ideally, the massage balls 156 should be removable so as to allow different shaped heads to be supported by the apparatus 100. Securement and removal of massage balls 156 may be achieved by utilizing a collet 158 with a slight splay and an attachment rib and a push button 159 having two distal prongs. As shown in FIGS. 14 and 15, the collet 158 sits outside of the massage ball 156 and acts as a hub. It also interacts with a groove on the axle 154 to lock the massage balls in place about the caster body 152. When the button 159 is depressed, its prongs force open the collet 158 at the splay and release the axle 154, thus releasing the massage ball 156. Differently shaped, differently knurled, and different durometer massage balls may then be used on the same apparatus. It should be noted that while the term "ball" may imply a spherical object, such an implication is not necessarily to be assumed, as the illustrated massage balls 156 are not perfectly spherical. It should be readily apparent that non-spherical "balls," including prisms and cylinders, may be utilized on the apparatus as a suitable massage surface.

As can be seen in FIGS. 16A-16D, the massage head may rotate with respect to the outer support tube 110. This may be accomplished by providing a pedestal 160 on the outer support tube 110 (FIG. 7) and spring biasing 162 the caster body 152 and pedestal 160 together (FIGS. 14, 15). A simple pin and groove interface, possibly using one of the spring mounts as a pin. Detents in the groove provide stops for the pin. Pulling the caster body 152 so the pin is in the groove allows for rotation to any one of the available stops. While four are illustrated, it should be appreciated that any desired number of stops that may be feasibly built into the groove may be utilized.

Figure 18:
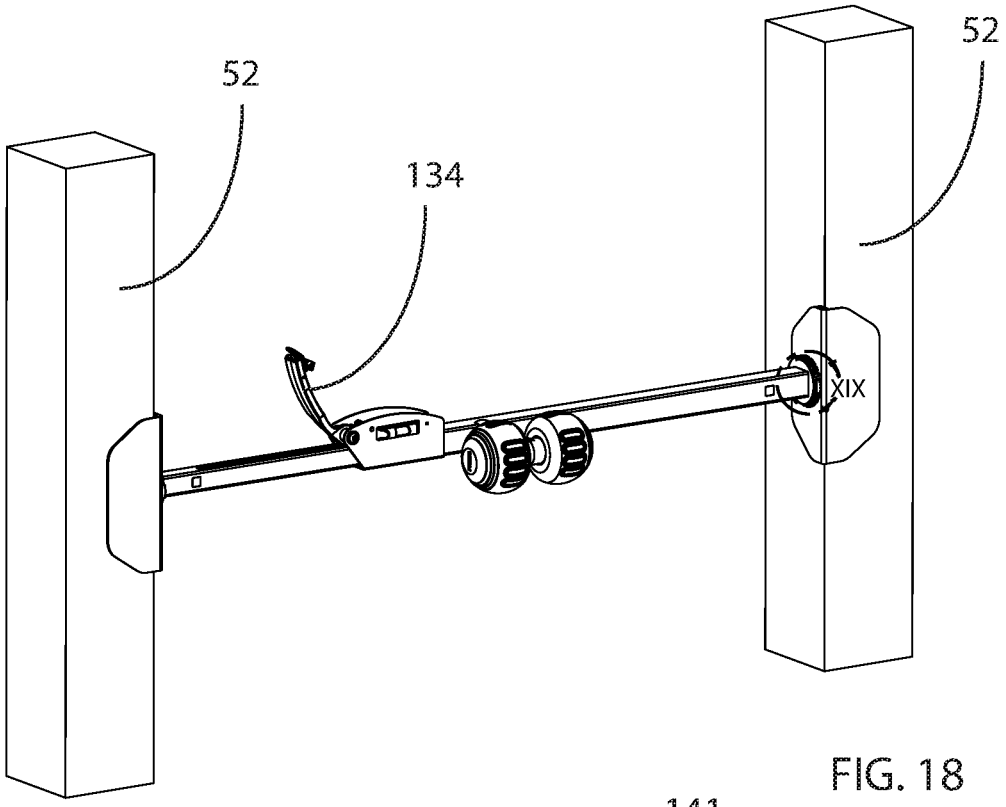
FIG. 18 is a perspective view of the self-massage apparatus of FIG. 1, unsecured but mounted in a doorway.
Figure 19:
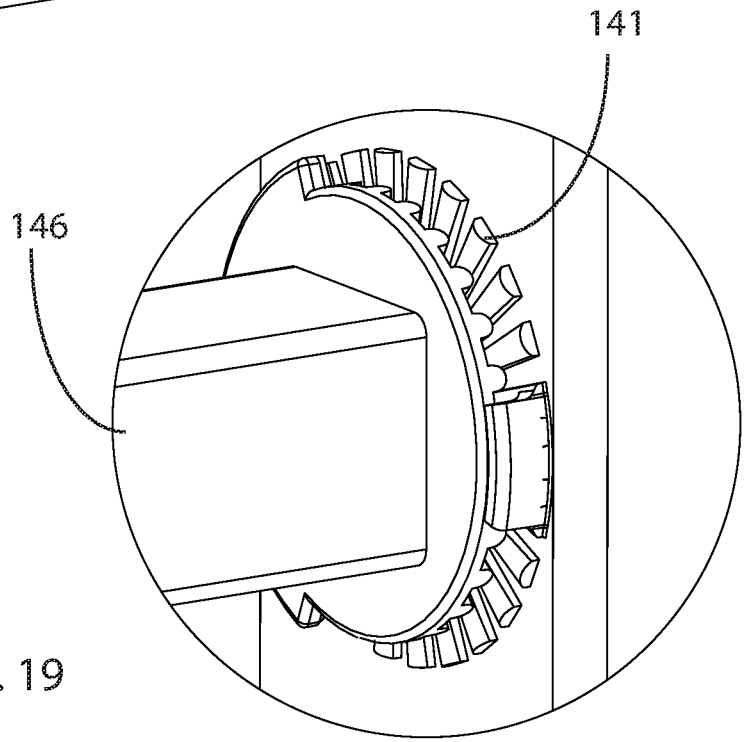
FIG. 19 is a close-up view of a rotation lock used with self-massage apparatus of FIG. 18, taken in circle XIX.
Figure 20:
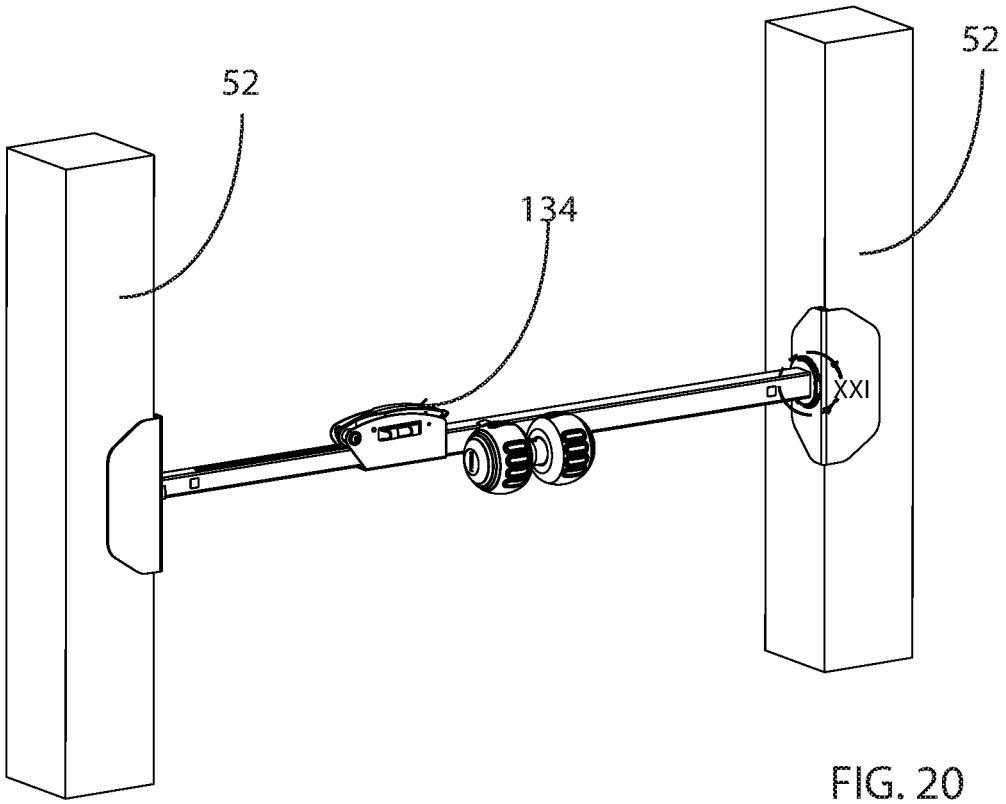
FIG. 20 is a perspective view of the self-massage apparatus of FIG. 1, securely mounted in a doorway.
Figure 21:
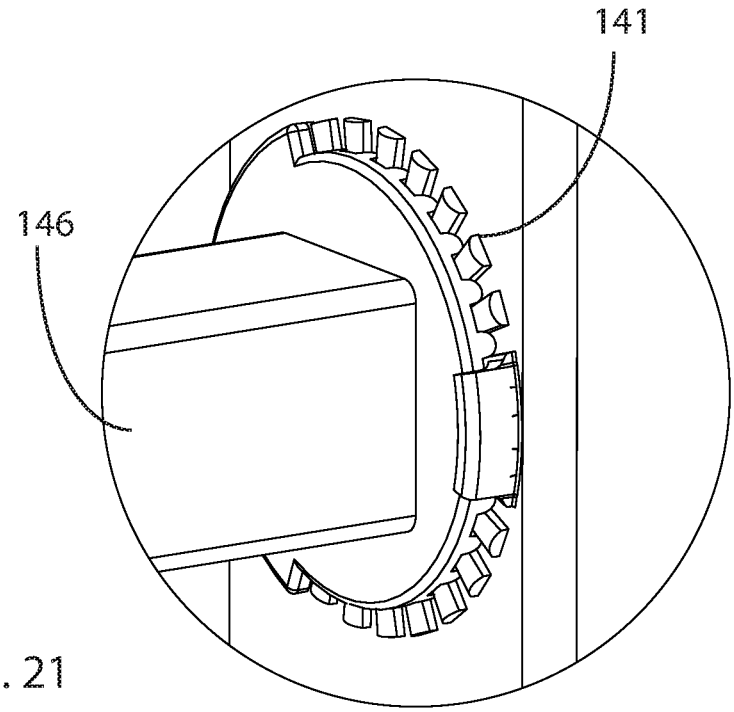
FIG. 21 is a close-up view of a rotation lock used with self-massage apparatus of FIG. 18, taken in circle XXI.

Rotation of the apparatus within a door frame (FIGS. 17-21) is accomplished by an interaction of parts in the support brackets 140. Each support bracket 140 is secured to opposed ends of the apparatus at a shoulder 146 which in turn supports the bracket head 142. A bolt 147 and nut 149 hold the shoulder 146 and head 142 together with a spring 148 located between them in a manner to bias them apart. A pad 144 covers the bolt head. On the inside wall of the bracket head is a series of radial teeth 141 with a corresponding series positioned on the outside of the bracket shoulder 146. When positioned against a door jamb 50, but not latched (FIGS. 18, 19), the teeth will not interface with each other and the bolts 147 in both brackets will serve as axles for rotation of the remainder of the assembly in relation to the bracket heads 142. When the latch 130 is secured, the additional length of inner tube 120 pushed outward will also counter the spring bias 148 and intermesh the radial teeth 141, locking everything relative to each other (FIGS. 20, 21).

Connection between the tubes 110, 120 and the end cap 126, guide 124, and bracket shoulders 146 may be accomplished though any means known in the art or later discovered. Connections may be permanent, semi-permanent, or temporary. It is preferred that the pieces may be removable from each other for maintenance and repair purposes. For this reason, boss interfaces are illustrated in the figures as they are reasonably secure while also providing the ability to take the pieces apart. Other means, such as nuts and bolts, welding, soldering, spring pins or the like may be utilized.

Figure 22:
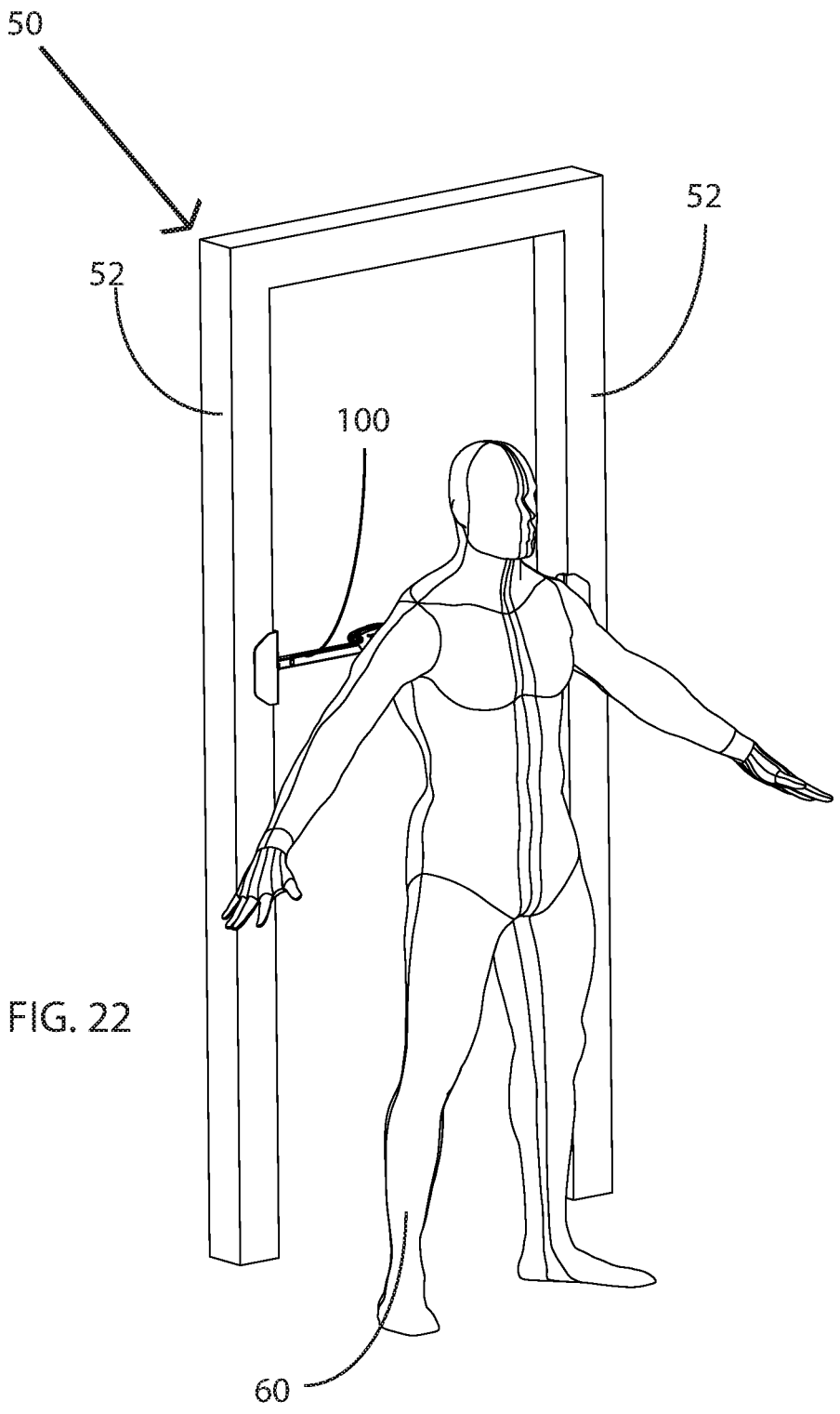
FIG. 22 is an alternate perspective view of the self-massage apparatus of FIG. 21, in use.
Figure 23:
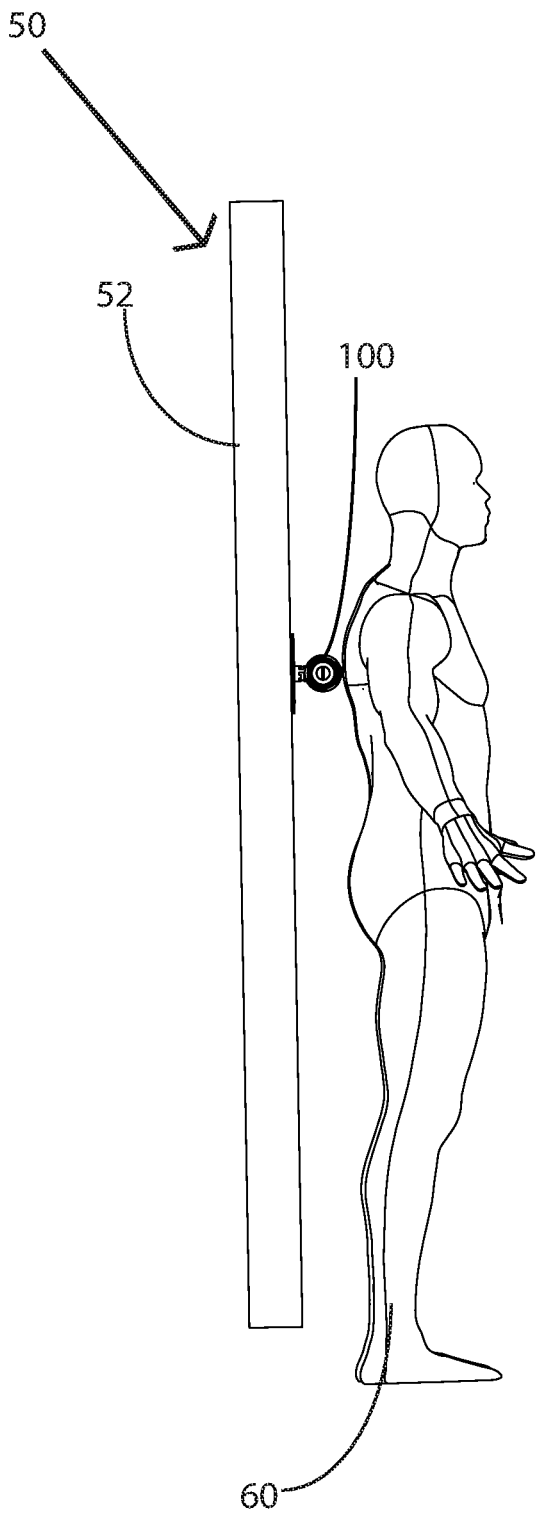
FIG. 23 is a side elevation of the self-massage apparatus for FIG. 22.
Figure 24:
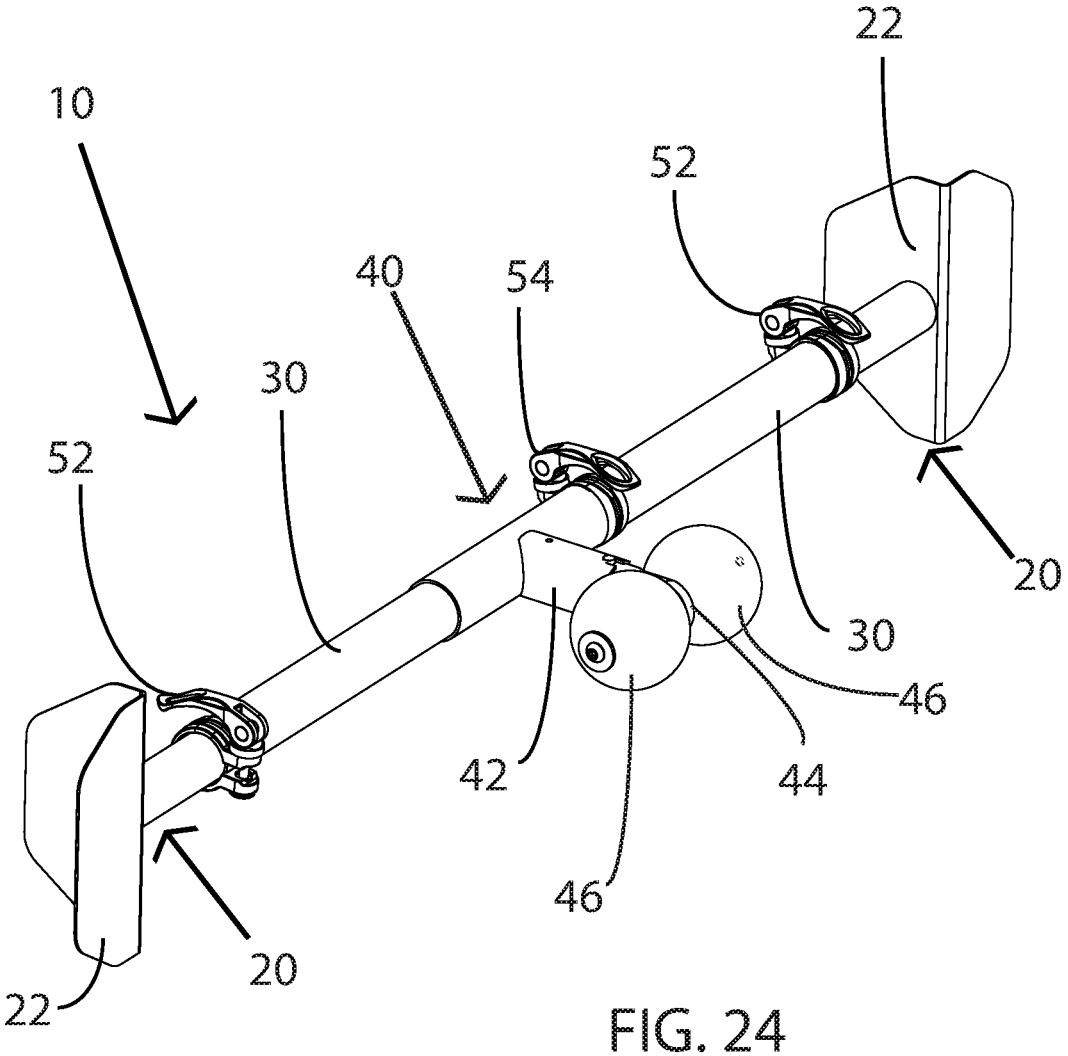
FIG. 24 is a perspective view of a self-massage apparatus.

In use then, the massager is mounted in a door frame 50, as is illustrated in FIG. 8. Once secure, a user 60 then leans against the massager (FIGS. 22, 23) and flexes the user's knees to create a massaging force on the user's back. Positioning of the massager into different areas and orientations is simply accomplished by loosening the latch apparatus 130 and moving the massage apparatus 100 as desired. Likewise, the user may position himself in any manner to address physical needs, included a seated or inclined orientation. A level 118 in its casing 116 (FIG. 7) may provide additional utility.

Figure 27:
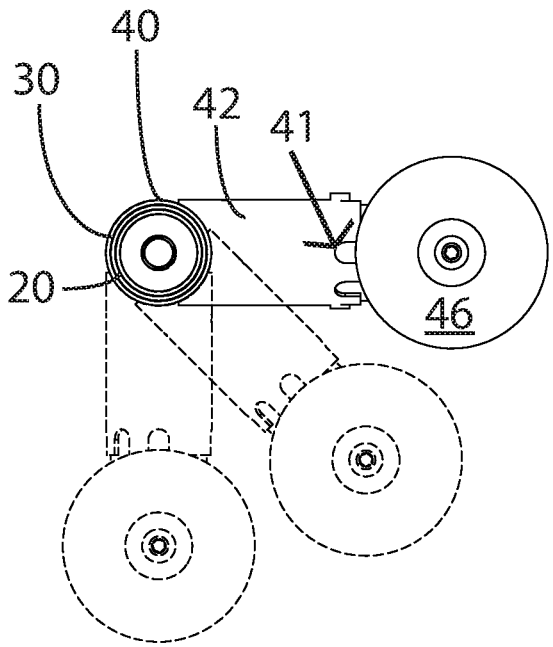
FIG. 27 is a sectional view of the self-massage apparatus of FIG. 24, taken along line 4-4 of FIG. 25.

In an alternate embodiment (FIGS. 24-30), a self-massage apparatus 10 may have a hollow base tube 30 and two coaxial inner rods 20 slidable within. An outer sleeve 40 should also be present about the tubular base 30. Lateral clamps 52 may be used to affix the inner rods 20 in a longitudinal relationship with tubular base 30. Likewise, inner clamp 54 holds outer sleeve 40 and tubular base 30 in a fixed relationship. However, loosening the inner clamp 54 should allow the outer sleeve 40 to rotate about the tubular base 30 (FIG. 27).

Figure 25:
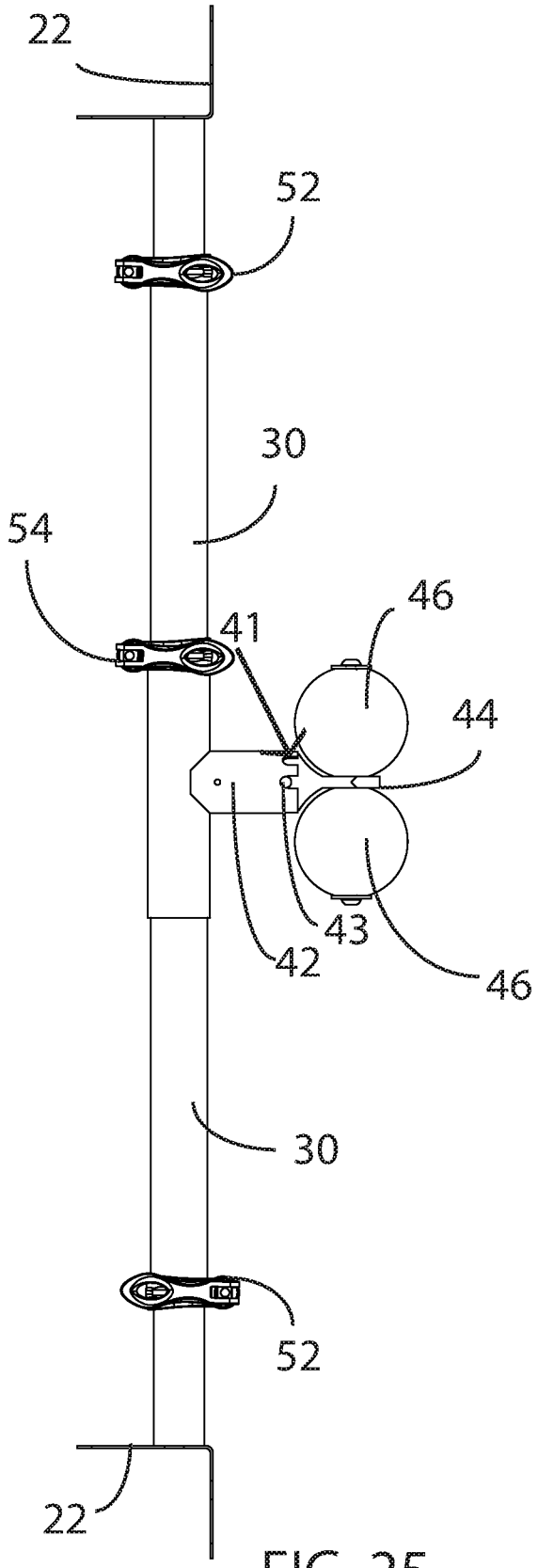
FIG. 25 is a top plan view of the self-massage apparatus of FIG. 24.
Figure 26:
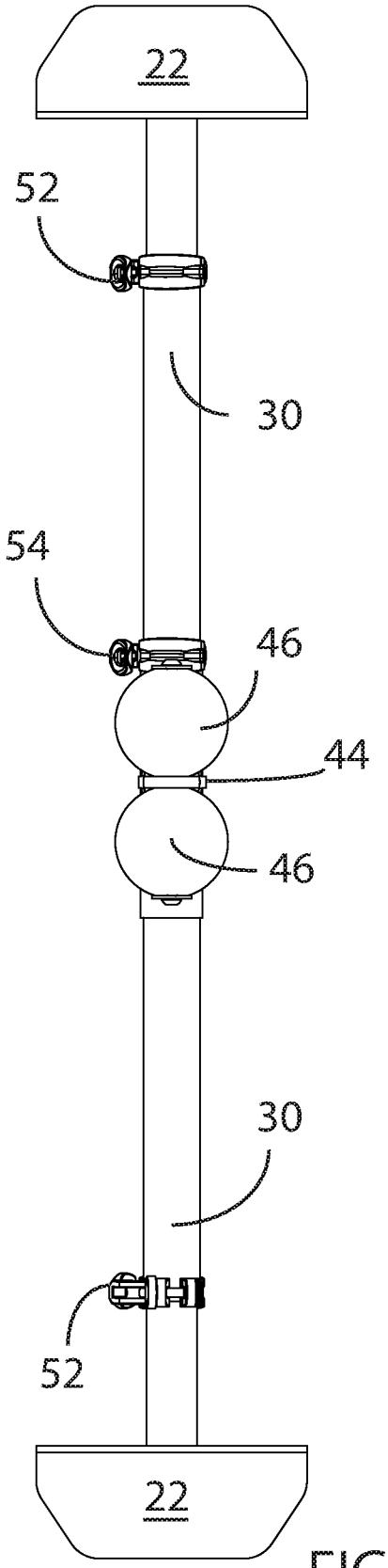
FIG. 26 is a side elevation of the self-massage apparatus of FIG. 24.
Figure 28:
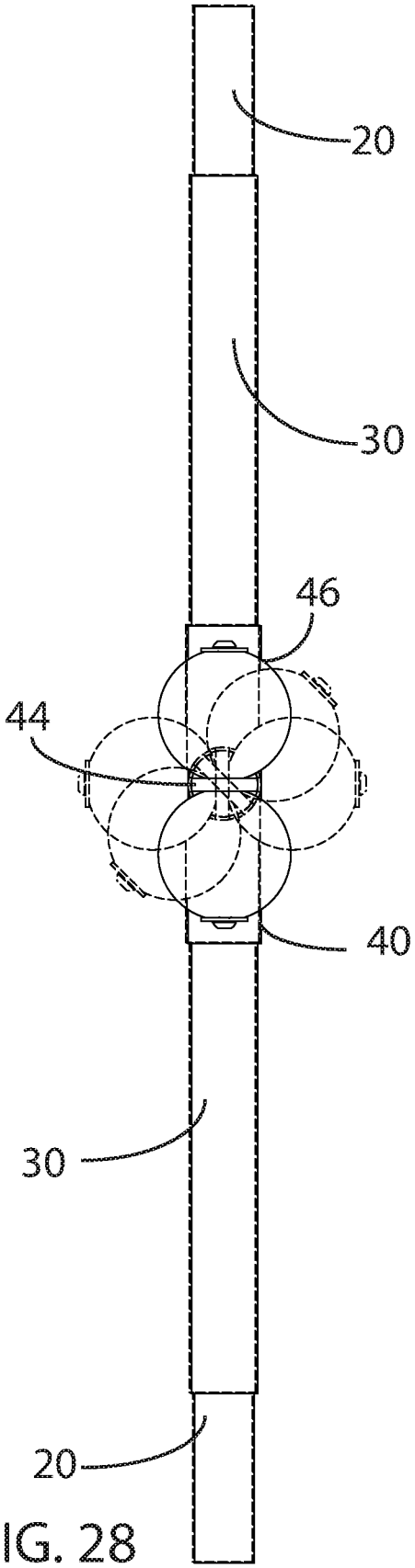
FIG. 28 is a partially exploded view of the self-massage apparatus of FIG. 24.
Figure 29:
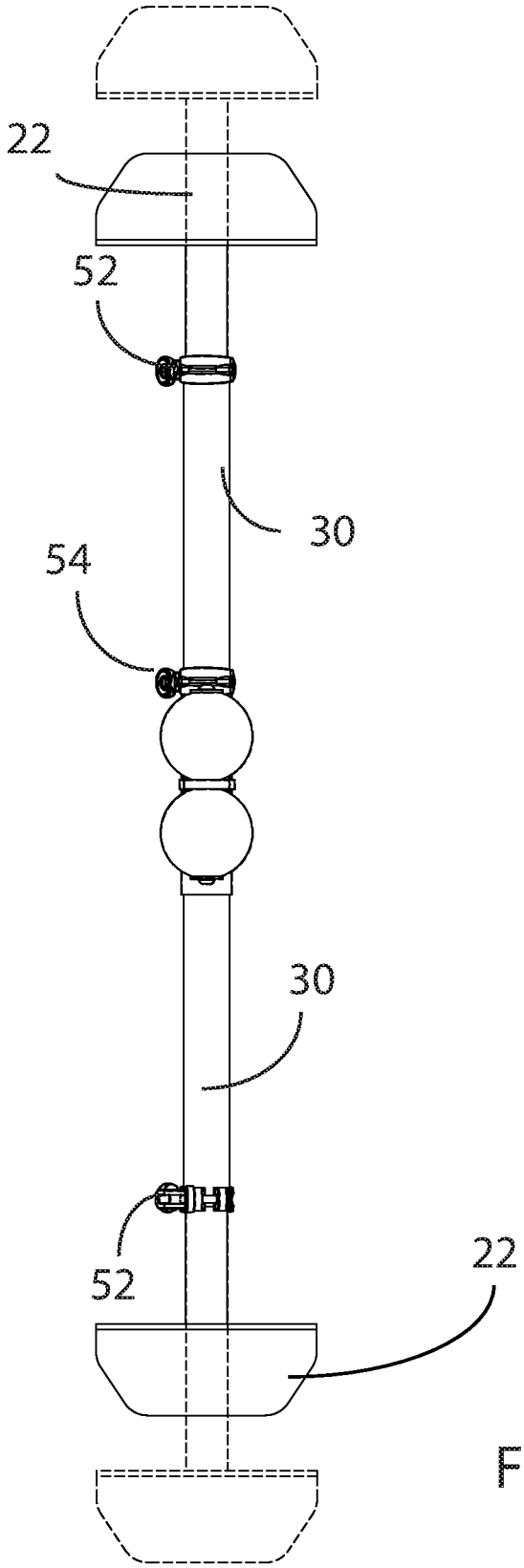
FIG. 29 is a side elevation of the self-massage apparatus of claim 24, showing the extension of its arms.
Figure 30:
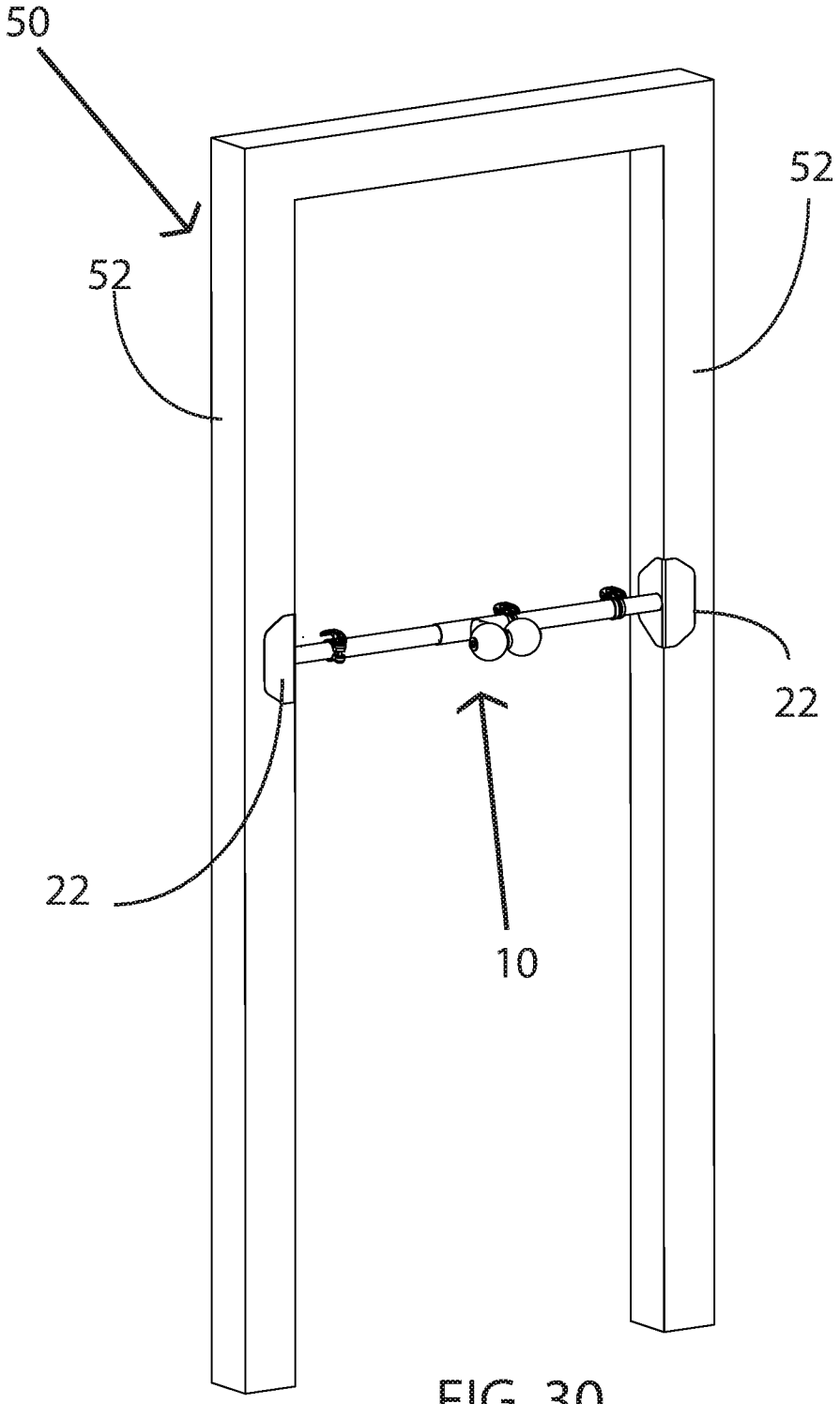
FIG. 30 is a perspective view of the self-massage apparatus of FIG. 24, mounted in a door frame.

The outer sleeve 40 may also present a massage head of any form. In the illustrated embodiment, an anchor post 42 extends from the outer sleeve 40 and serves as an anchor for a massage head. The depicted massage head is a pair of massage balls 46 mounted as part of a caster 44. The caster 44 is ideally held in a given position for use by an individual, and any means sufficient to the task may be employed. The depicted means is a notch-and-peg interface, where peg 43 interfaces with one of many notches 41 about the rim of post 42 (FIG. 25). In this embodiment, the caster 44 may be held in place by a retaining force (not shown) or any other means known or later developed. Usage of the retaining force allows the caster 44 to be selectively rotated about the anchor rod 42 (FIG. 28).

Each of the coaxial inner rods 20 features an end bracket 22 configured to interface with two opposed structures. The end brackets 22 may be of any suitable shape or design, dependent upon the mounting strategy of the massager 10. The illustrated end brackets 22 are designed for mounting the massager 10 in a door frame. Like in the preferred embodiment, the end brackets 22 are two orthogonal walls and present a generally L-shaped profile (FIG. 23) with two perpendicular interface surfaces. The coaxial inner rods 20 may extend (FIG. 29) from the tubular base 30 so as to accommodate mounting in various sized locations. The massager 10 will then be able to mount in any suitably sized opening between two opposed corner surfaces, such as with opposed jambs 52 in a door frame 50 (FIG. 30) with the inner leg of each bracket abutting the inner surface of the opposing surfaces and providing tension sufficient to hold the massage apparatus 10 in place and the outer leg of each bracing the massager against the force of the use of the massager. A separate tensioner may be added to increase the tension in the massage apparatus 10 and maintain its vertical positioning.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A self-massage apparatus comprising:

a tubular base bar;

two support rods, coaxial with each other and the tubular base bar and in a sliding relationship with the tubular base bar;

each support rod terminating in a support bracket with an "L" shape;

a support sleeve, located externally on the tubular base bar and having a slidable relationship therewith, said support sleeve further comprising:

a tubular body;

a post extending radially from the tubular body;

a massage head mounted upon an end of the post; and a means for securing the support sleeve relative the tubular base bar; and at least one means for tensioning the tubular base bar and support sleeve.

2. The self-massage apparatus of claim 1, further comprising a plurality of tube clamps.

3. A self-massage apparatus comprising:

a support tube;

a massage head mounted upon an outer surface of the support tube;

an inner sliding tube, the support tube and sliding tube being coaxial and nested together;

two support brackets, one attached to an end of the support tube and another attached to an opposite end of the inner sliding tube; and a tensioning latch to bias the inner sliding tube in relation to the support tube and hold the support tube and the inner sliding tube in relative position to each other, said tensioning latch further comprising:

a series of grooves fashioned in a top of the inner sliding tube;

two support walls;

a latch handle with interface teeth such that when the latch handle is engaged, the interface teeth rotate and grab at least one of the series of grooves, forcing the inner sliding tube outwards with respect to the support tube;

a support bolt, supporting the latch handle on the two support walls, said support bolt residing in two angled pill-shaped holes and a spring bias to force the support bolt downward in the pill-shaped holes wherein the pill-shaped holes are angled such that when the support tube and inner sliding tube are tensioned, the support bolt is forced downwards.

4. A self-massage apparatus comprising:

a support tube;

an inner sliding tube, the support tube and sliding tube being coaxial and nested together;

two support brackets, one attached to an end of the support tube and another attached to an opposite end of the inner sliding tube;

a tensioning latch to bias the inner sliding tube in relation to the support tube and hold the support tube and the inner sliding tube in relative position to each other; and a rotatable massage head mounted upon an outer surface of the support tube, the rotatable massage head further comprising:

a caster body and a pedestal the caster body and pedestal being spring tensioned together and interfacing with each other with a pin-and-groove structure having a plurality of stops.

5. A self-massage apparatus comprising:

a support tube;

a massage head mounted upon an outer surface of the support tube;

an inner sliding tube, the support tube and sliding tube being coaxial and nested together;

a tensioning latch to bias the inner sliding tube in relation to the support tube and hold the support tube and the inner sliding tube in relative position to each other; and two support brackets, rotatable about an axis defined by the support tube and inner sliding tube where one is attached to an end of the support tube and another is attached to an opposite end of the inner sliding tube, the support brackets further comprising:

a bracket head;

a bracket shoulder, said bracket head and bracket shoulder being spring biased apart; and radial teeth positioned upon both a surface of the bracket shoulder and a surface of the bracket head such that said radial teeth intermesh when the self-massage apparatus is securely mounted.

6. A self-massage apparatus comprising:

a support tube;

an inner sliding tube, the support tube and sliding tube being coaxial and nested together;

two support brackets, one attached to an end of the support tube and another attached to an opposite end of the inner sliding tube;

a tensioning latch to bias the inner sliding tube in relation to the support tube and hold the support tube and the inner sliding tube in relative position to each other; and a massage head mounted upon an outer surface of the support tube, the massage head further comprising:

a caster structure with a caster body; and at least one massage surface further comprising:

two massage balls co-mounted on an axle attached to the caster body;

at least one splayed collet serving as a hub and attaching to the axle; and at least one button having at least one post such that when depressed, the at least one button will further splay the at least one collet and release the axle.

7. The self-massage apparatus of claim 6, the tensioning latch further comprising: a series of grooves fashioned in a top of the inner sliding tube and a latch handle with interface teeth such that when the latch handle is engaged, the interface teeth rotate and grab at least one of the series of grooves, forcing the inner sliding tube outwards with respect to the support tube.

8. The self-massage apparatus of claim 7, the tensioning latch further comprising two support walls, a support bolt on which the latch handle is mounted and a pill-shaped hole in each of the support walls, into which the support bolt is mounted, and a spring bias to force the support bolt downward in the pill-shaped holes.

9. The self-massage apparatus of claim 8, the pill-shaped holes being angled, with the pill shaped holes are angled such that when the support tube and inner sliding tube are tensioned, the support bolt is forced downwards.

10. The self-massage apparatus of claim 9, the massage head being rotatable.

11. The self-massage apparatus of claim 10, the massage head further comprising a caster body and a pedestal which are spring tensioned together, the caster body and pedestal interfacing with each other with a pin-and-groove structure having a plurality of stops.

12. The self-massage apparatus of claim 11, the two support brackets being rotatable about an axis defined by the support tube and inner sliding tube where one is attached to an end of the support tube and another is attached to an opposite end of the inner sliding tube.

13. The self-massage apparatus of claim 12, the support brackets further comprising:

a bracket head;

a bracket shoulder, said bracket head and bracket shoulder being spring biased apart; and radial teeth positioned upon both a surface of the bracket shoulder and a surface of the bracket head such that said radial teeth intermesh when the self-massage apparatus is securely mounted.

* * * * *